United States Patent [19]

Stokes

[11] Patent Number: 4,530,272

[45] Date of Patent: Jul. 23, 1985

[54] METHOD FOR CONTROLLING CONTAMINATION IN A CLEAN ROOM

[75] Inventor: Konrad H. Stokes, Los Gatos, Calif.

[73] Assignee: International Business Machines Corporation, Armonk, N.Y.

[21] Appl. No.: 570,573

[22] Filed: Jan. 13, 1984

[51] Int. Cl.[3] ..... F24F 13/00

[52] U.S. Cl. ..... 98/34.5; 55/210; 55/385 A

[58] Field of Search ..... 98/33 A, 33 R; 55/210, 55/473, 467, 385 A, DIG. 29, DIG. 28; 73/28

[56] References Cited

U.S. PATENT DOCUMENTS

| | | | |
|---|---|---|---|
| 3,367,257 | 2/1968 | Raider et al. | 98/33 |
| 3,518,814 | 7/1970 | Maynard | 55/210 |
| 4,100,347 | 7/1978 | Norton | 98/115 |
| 4,137,831 | 2/1979 | Howorth | 98/36 |
| 4,155,725 | 5/1979 | Van Ackeren et al. | 55/210 |

OTHER PUBLICATIONS

"Jet Stream Ventilation for Extreme Air Cleanliness", P. Kranz, *Ashrae Journal,* Aug. 1962, p. 37.

"Modern Control Engineering", K. Ogata, Sec 13-2, pp. 625-626.

"Ashrae Handbook & Product Directory 1978 Applications", American Society of Heating, Refrigerating & Air-Conditioning Engineers, Inc., Chapter 17.

*Primary Examiner*—William E. Wayner
*Assistant Examiner*—John Sollecito
*Attorney, Agent, or Firm*—Henry E. Otto, Jr.

[57] ABSTRACT

A method is disclosed for controlling the concentration of airborne particulate contaminants in a clean room environment. Air under pressure is continually recirculated through the environment and filtered as it is circulating. Mixing of the filtered air is enhanced by imparting turbulence thereto sufficient to render the filtered air substantially homogenous. The particle count of the filtered air is sensed within the environment and the volume of air that is recirculated is controlled according to the sensed particle count to thereby maintain the particle count substantially at a preselectable concentration.

7 Claims, 3 Drawing Figures

METHOD FOR CONTROLLING CONTAMINATION IN A CLEAN ROOM

FIELD OF THE INVENTION

This invention relates to a method for controlling the degree of concentration of contaminants in a clean room. The term "clean room", as hereinafter used, is intended generically to include industrial clean rooms for making products, drugs or chemicals, and also hospital operation rooms and similar environments where contamination by airborne particles or bacteria must be closely controlled.

BACKGROUND OF THE INVENTION

Heretofore it has been the practice in clean rooms to direct a constant stream of laminar air under pressure through a zone containing the product or other object to be protected from contamination and take steps to insure against turbulence. This laminar air stream usually is achieved by directing air at constant velocity via High Efficiency Particulate Air (HEPA) filters and diffusers mounted in the ceiling downwardly past the object or area to be protected, through apertures in a preferably grated floor then via return ducts back to the ceiling and through the HEPA filters for substantially continual recirculation.

U.S. Pat. Nos. 3,367,257, 4,100,347 and 4,137,831 disclose clean rooms or other substantially closed environments in which filtered air is diffused and directed as a laminar air stream through a work zone. Also, *Ashrae Journal,* August 1962, p. 37, "Jet Stream Ventilation for Extreme Air Cleanliness" discloses a hospital operating room in which a sterile zone of completely filtered air is provided around the patient by a recirculating flow of air that "should be quite laminate and hence have relatively thick boundary layers".

Clean rooms of this Vertical Laminar Flow (VLF) type operate very satisfactorily and provide air in the work zone that is as clean as can be supplied by the HEPA filters used. It is therefore preferred for those clean rooms classified under U.S. Federal Standard 209B as Class 10, Class 100 or even Class 1,000. However, these VLF systems are very expensive because of the large number of HEPA filters needed.

To reduce cost, there is a need for a novel approach to clean room contamination control that is especially suited for clean rooms classified as Class 10,000 or Class 100,000; i.e., those that do not have to be maintained "super clean".

SUMMARY OF THE INVENTION

Toward this end and according to the invention, there is provided an improved method for controlling the concentration of airborne contaminants in a clean room environment where complete elimination of these contaminants is not required. This method involves intentionally imparting turbulence to the air downstream of the HEPA filters to so thoroughly mix the filtered air that it becomes substantially homogenous, and controlling the particulate concentration by controlling the volume of air that is recirculated according to the sensed particle count for thereby maintaining the particle count substantially at a preselectable concentration.

DESCRIPTION OF PREFERRED EMBODIMENT

Figure 1:
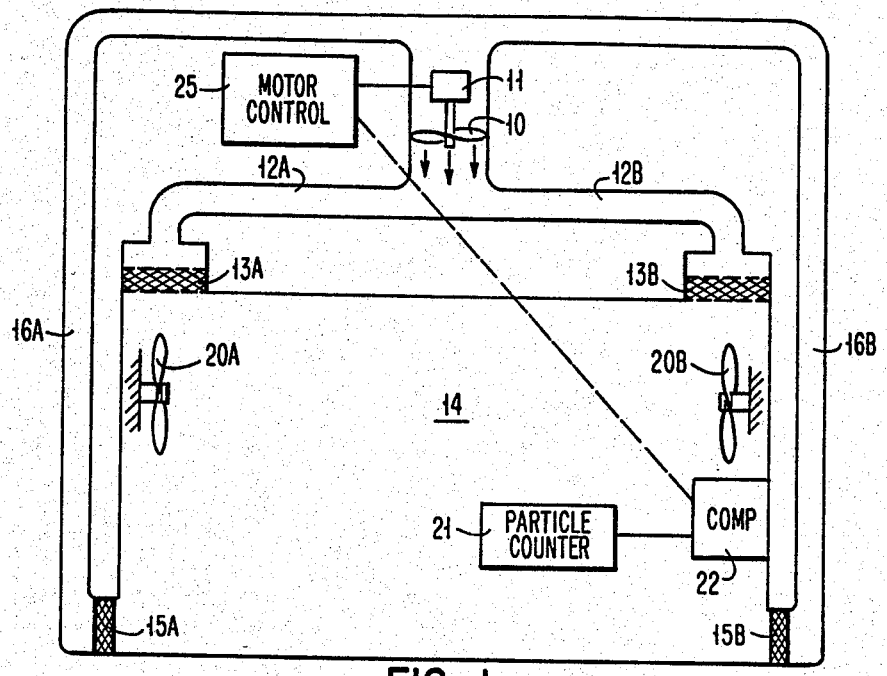
FIG. 1 is a schematic representation of a dilution-controlled clean room system illustrating the invention.

As illustrated in FIG. 1, a system embodying the invention comprises a fan 10 driven continuously by a motor 11 to supply air via ducts 12A, B and HEPA filters 13A, B to a substantially enclosed environment, such as clean room 14. The filtered air is drawn through prefilters 15A, B near the floor and up through return ducts 16A, B then recirculated by the fan through filters 13A, B continuously.

According to the invention, the filtered air supplied to clean room 14 is intentionally rendered turbulent and thoroughly mixed, and the rate of flow and hence volume of filtered air through the clean room is controlled as necessary to maintain the airborne particle (or bacteria) concentration substantially at a value preselected by an operator. As illustrated in FIG. 1, turbulence is achieved by the fan 10 assisted by mixing devices, such as oscillating fans 20A, B or the like within the clean room 14. The fans 20 are operated continuously to ensure thorough mixing of the air after filtering so that the air within the clean room will be rendered substantially homogenous; i.e., have a substantially constant particle count per unit volume.

Figure 2:
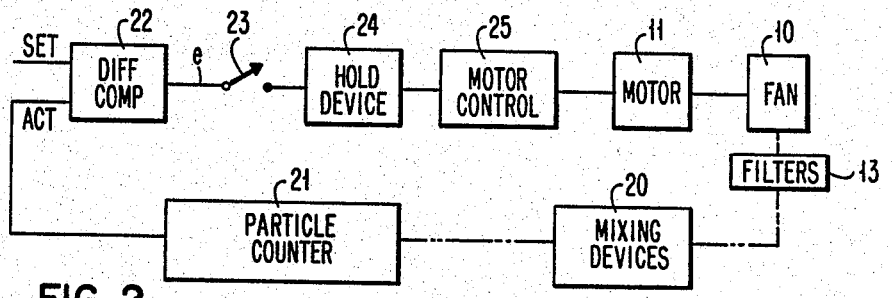
FIG. 2 is a schematic representation of circuitry for controlling particle concentration in said system.

Referring now to FIG. 2, a particle counter 21 constantly senses the count of airborne particles (or bacteria) within clean room 14. This counter 21 provides an electrical input signal indicative of actual particle count to a controller which, for example, may be a differential comparator 22. Comparator 22 has another input corresponding to a desired particle count as preselected by an operator. Comparator 22 operates to provide, as an output, a positive or negative error signal e according to whether the actual particle count is less than or greater than the preselected particle concentration count, respectively, and of a magnitude corresponding to the extent of the deviation of the actual from the preselected count.

Error signal e is fed via a conventional sampler switch 23 and holding device 24 to motor control circuitry 25. Switch 23 operates to sample the then existing error signal e by closing for a brief instant every T seconds to create a train of pulses at each sampling instant 0, T, 2T . . . . Between sampling instants, no sampling of signal e occurs; but the holding device 24 converts the sampled signal into a corresponding continuous signal to cause motor control circuitry 25 to operate to adjust the speed of fan motor 11 in accordance with the error signal e as sampled and held. Thus, sampling switch 23 and holding device 24 operate to provide a certain degree of hysterisis or damping by periodically (rather than continuously) adjusting the speed of fan 10 and hence the volume of air circulated through the clean room as necessary to maintain the particle count as measured by counter 21 at the concentration preselected by the operator. In FIG. 2, the solid lines linking devices 21–25, 11 and 10 depict electrical connections for transmitting analog or digital signals;

and the broken lines indicate components in the air flow path.

Figure 3:
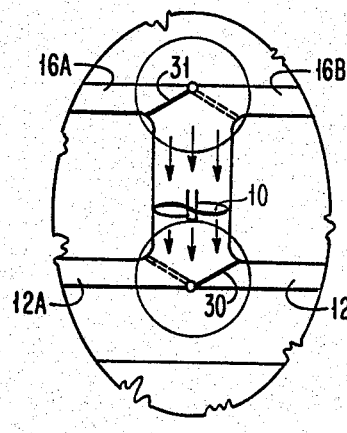
FIG. 3 is a fragmentary schematic representation of a portion of the system of FIG. 1 modified to incorporate an optional dampering mechanism.

According to an optional variation of the preferred embodiment, and as illustrated in FIG. 3, dampers 30, 31 are interposed in ducts 12 and 16, respectively, to repeatedly change the air flow patterns in clean room 14. This is especially desirable where the clean room is very large or the air inlets 12A, B and return ducts 16A, B are widely spaced. Dampers 30, 31 are moved at the end of preselected time periods repeatedly from respective first positions in which they are shown to respective second positions indicated by dash lines and then back to their said first positions.

Thus, as illustrated in FIGS. 1 and 3, air flow from fan 10 is diverted via duct 12A, through filter 13A and prefilter 15B and return duct 16B back to fan 10. After the preselected time period, a timing device (not shown) operates to switch the dampers 30, 31 concurrently from their respective first positions to their respective second positions in which air flow from fan 10 is diverted via duct 12B through filter 13B and prefilter 15A and return duct 16A, back to fan 10. Note, however, that there should always be some residual flow past the dampers 30, 31 when in their respective flow-obstructing positions to ensure against contamination of the downstream surfaces of filters 13A, B. Also, the frequency of change of the flow pattern for a particular clean room configuration should be determined by experimentation, and the flow should be reversed as soon as a particular flow pattern is established.

It will thus be seen that the dampers 30, 31 operate in unison to cause the return air to be drawn from the opposite side of the room from the HEPA filter 13 that is then supplying air to the clean room 14. This desirably produces a push-pull flow of air, repeatedly changing the flow pattern in clean room 14. With applicant's improved method, air flow is kept at a minimum during low activity periods when few particles are being generated, thereby saving energy. However, as activity increases, flow is automatically increased to quickly return the particle count to the preselected concentration value. Also, fans 20A, B desirably enhance mixing and reduce standing currents, but may not be required in all cases. It will also be understood that, if preferred, the error signal e may be used to access a look-up table associated with a microprocessor to identify and apply the appropriate correction signal to the motor control circuitry 25.

While the invention has been shown and described with reference to a preferred embodiment thereof, it will be understood by those skilled in the art that the foregoing and other changes in form and detail may be made therein without departing from the spirit, scope and teaching of the invention. Accordingly, the method herein disclosed is to be considered merely as illustrative and the invention is to be limited only as specified in the claims.

What is claimed is:

1. A method for controlling the concentration of particulate contaminants in a clean room environment, said method comprising the steps of:

supplying filtered air under pressure to the environment;

enhancing mixing of the air after filtering by imparting turbulence thereto sufficient to render the filtered air substantially homogenous;

sensing the particle count of the filtered air within the environment; and controlling the volume of air that is recirculated according to the sensed particle count for thereby maintaining the particle count substantially at a preselectable concentration.

2. A method according to claim 1, including, during the enhancing step, using oscillating fans to impart turbulence.

3. A method according to claim 1, including the step of continually recirculating the air through the environment, and filtering the air at least once each recirculation cycle.

4. A method according to claim 1, including diverting the air under pressure into a selectable one of a plurality of flow paths while significantly restricting flow through the remaining flow paths to further enhance mixing.

5. A method according to claim 1, including repeatedly diverting the air under pressure, in alternating fashion, into one or the other of two flow paths which generally criss-cross the clean room environment from top to bottom.

6. A method according to claim 5, wherein as soon as either of the two flow paths is established, the air is diverted to the other flow path to further enhance mixing.

7. A method for controlling the concentration of particulate contaminants in a clean room environment, said method comprising the steps of:

providing to the environment air which is filtered and intentionally rendered sufficiently turbulent to thoroughly mix the air and make it substantially homogenous;

sensing the particle count of the filtered air within the environment; and controlling the volume of air that is recirculated according to the sensed particle count for thereby maintaining the particle count substantially at a preselectable concentration.

* * * * *